US005267922A

United States Patent [19]

Robinson

[11] Patent Number: 5,267,922

[45] Date of Patent: Dec. 7, 1993

[54] SIMULATED STAIR EXERCISER

[76] Inventor: Eldon L. Robinson, 217 - 13918 72nd Avenue, Surrey, B. C., Canada, V3W 0T4

[21] Appl. No.: 909,302

[22] Filed: Jul. 6, 1992

[51] Int. Cl.[5] ..... A63B 21/00

[52] U.S. Cl. ..... 482/52; 482/908

[58] Field of Search ..... 482/51, 52, 53, 111, 482/908

[56] References Cited

U.S. PATENT DOCUMENTS

| | | | |
|---|---|---|---|
| 304,358 | 10/1989 | Armstrong . | |
| 4,496,147 | 1/1985 | DeCloux et al. | 482/53 |
| 4,645,197 | 2/1987 | McFee | 482/111 |
| 4,733,858 | 3/1988 | Lan | 482/53 |
| 4,900,012 | 2/1990 | Fu | 482/52 |
| 5,013,031 | 5/1991 | Bull . | |

*Primary Examiner*—Stephen R. Crow

*Attorney, Agent, or Firm*—Barrigar & Oyen

[57] ABSTRACT

This invention pertains to a novel simulated stair exerciser. More particularly, this invention relates to a simulated stair exercise apparatus which is lightweight, portable, and can be converted from an upright position when in use to a compact fully collapsed position which can be stored away. A simulated stair exercise apparatus comprising: (a) a base; (b) a slide frame, a first end of which is pivotally attached to the base; (c) a leg frame pivotally attached to the slide frame at a second end of the slide frame, the end of the leg frame removed from the pivotal end being detachably connectable to the base; (d) a handle pivotally connected to the leg frame or the slide frame; (e) a pair of detachable foot rests adapted to move upwardly or downwardly along the slide frame; and (f) an adjustable tension member which exerts a resistance force on the foot rests and enables the slide resistance of the foot rests to be varied.

10 Claims, 6 Drawing Sheets

SIMULATED STAIR EXERCISER

FIELD OF THE INVENTION

This invention pertains to a novel simulated stair exerciser. More particularly, this invention relates to a simulated stair exercise apparatus which is lightweight, portable, and can be converted from an upright position when in use to a compact fully collapsed position which can be stored away.

BACKGROUND OF THE INVENTION

Various types of equipment which can be used by a person for performing aerobic exercises have become very popular over the past decade or so. There are many designs of aerobic exercise equipment on the market, including Universal of Nautilus exercising machines, stationary bicycles, and leg and arm exercising equipment. A type of aerobic exercise apparatus which has become particularly popular is an apparatus which simulates climbing stairs. There are many designs of simulated stair exercisers on the market, available for a wide range of prices. An elaborate stair simulator is sold under the trade-mark STAIRMASTER. This apparatus has among other things a computerized program by which the resistance provided by the simulated stairs can be varied. This device is expensive and is not portable. Furthermore, the STAIRMASTER apparatus must remain erect at all times.

U.S. Pat. No. 304,358, Timothy O. Armstrong et al., assigned to Precor Incorporated, illustrates a stair climbing exercise apparatus which is constructed of a base, a handle, left and right foot levers, and hydraulic cylinders which provide adjustable resistance for the foot levers. A difficulty with this apparatus is that the foot pedals, since they are part of levers which are pivoted about a common fulcrum, do not remain level. Accordingly, the exerciser's feet do not remain horizontal while performing the simulated stair climbing exercise. Further, the apparatus cannot be collapsed into a compact position for storage.

U.S. Pat. No. 5,013,031, J. W. Bull, illustrates an exercise apparatus which comprises a support structure, a left foot lever pivotally connected to the support structure and a right foot lever pivotally connected to the support structure. A rotatable shaft is also rotatably attached to the support structure. A first clutch means is drivingly connected to the rotatable shaft. The first clutch means independently drives the rotatable shaft in a first-rotational direction when the first clutch means is rotated in the first-rotational direction. The first clutch means overrrides the rotatable shaft when the first clutch means is rotated in the counter first-rotational direction. A second clutch means is also drivingly connected to the rotatable shaft. The second clutch means independently drives the rotatable shaft in the first-rotational direction when the second clutch means is rotated in the first rotational direction.

This exercise apparatus suffers from the deficiency that the left foot lever and the right foot lever do not remain horizontal throughout their travel from an upper position to a lower position and vice versa. Accordingly, the exerciser's feet do not remain level throughout the exercise cycle, which would be the case if the exerciser were actually climbing a set of stairs. Also, the apparatus is not collapsible.

SUMMARY OF THE INVENTION

The invention is directed to a simulated stair exercise apparatus comprising: (a) a base; (b) a slide frame, a first end of which is pivotally attached to the base; (c) a leg frame pivotally attached to the slide frame at a second end of the slide frame, the end of the leg frame removed from the pivotal end being detachably connectable to the base; (d) a handle pivotally connected to the leg frame or the slide frame; (e) a pair of detachable foot rests adapted to move upwardly or downwardly along the slide frame; and (f) an adjustable tension means which exerts a resistance force on the foot rests and enables the slide resistance of the foot rests to be varied.

The slide frame can comprise first and second slide members positioned on each side of a central member, the side members being adapted to have the foot rests slide upwardly or downwardly on the upper surface of each slide member. The first and second slide members of the slide frame can have moveable first and second dollies on the respective interiors thereof, said dollies being adapted to have the foot rest detachably secured to the respective dollies through openings in the first and second slide members.

The slide frame can have in the interior thereof a wheel, with a cable with ends extending around the periphery of the wheel, the ends of the cable removed from the wheel being respectively connected to the respective first and second dollies in the respective first and second slide members. The exerciser can include a force means which exerts a force against the wheel, thereby enabling the degree of rotational resistance of the wheel to be adjusted.

The leg frame of the exerciser can be locked into position when connected to the base. The slide frame, leg frame and handle can be pivotally collapsed so that they are adjacent to the base to provide a compact configuration.

The pair of foot rests can travel in respective elongated slots formed in the first and second slide members of the slide frame, and the first and second dollies can travel inside the first and second slide members parallel to the slots.

The adjustable tension means can comprise at least one hydraulic or pneumatic cylinder which exerts adjustable resistance force to movement of the pair of foot rests. A pair of retractable arm rests can be secured to the handle and the base can have retractable wheels secured to the underside of the base.

A cable can connect the pair of foot rests to provide reciprocal action. The tension means can be a spring.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
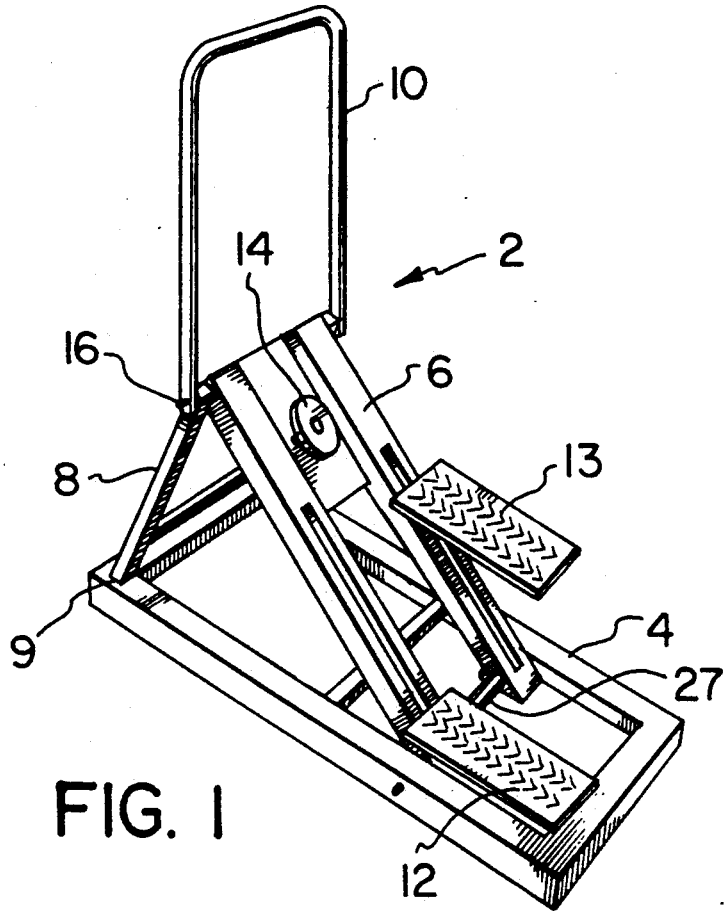
FIG. 1 illustrates an isometric view of the simulated stair exerciser in erect position.

Referring to the drawings, FIG. 1 illustrates an isometric view of the simulated stair exerciser 2 in erect configuration, ready for use by the person wishing to exercise. The simulated stair exerciser 2 is constructed of a rectangular base 4, a slanted slide frame 6, a slanted leg frame 8 which maintains the slide frame 6 in a slanted configuration relative to the horizontal base 4, and an upright handle 10. The slide frame 6 has extending in the same direction from each side thereof a pair of detachable horizontal foot rests 12 and 13. A tension adjustment handle 14 is rotationally secured to the top central portion of the slanted slide frame 6.

Figure 2:
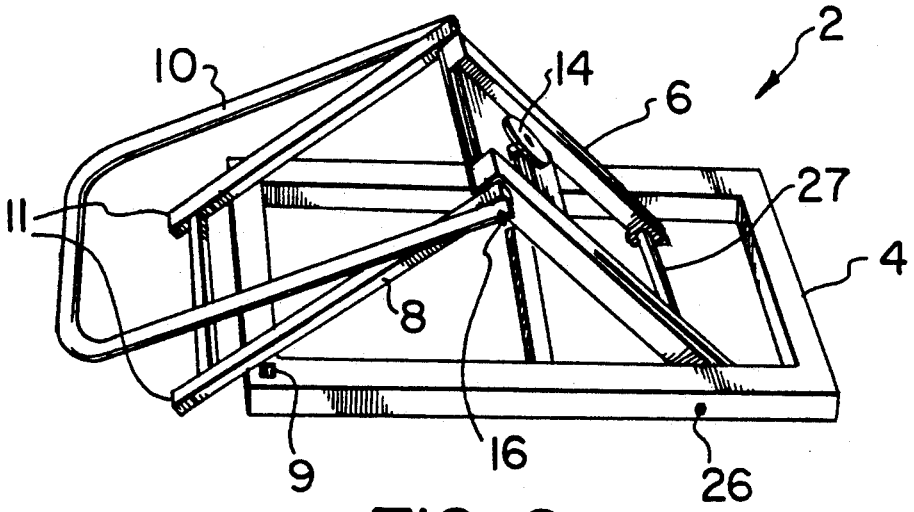
FIG. 2 illustrates an isometric view of the simulated stair exerciser in partially collapsed position.

FIG. 2 illustrates an isometric view of the simulated stair exerciser 2 in partially collapsed configuration. As seen in FIG. 2, the handle 10 has been pivotally moved downwardly to a forward position, and the bottom feet 11 of the slanted leg frame 8 have been removed from the respective leg holding receptacles 9 which are constructed in the corners of the front portion of the base 4. In the fully erect position, as seen in FIG. 1, the feet 11 of the leg frame 8 are fully inserted into the respective leg frame receptacles 9.

The handle 10 can pivot relative to slide frame 6 and leg frame 8 about a pair of handle pivot pins 16. The slide frame 6 can pivot relative to the base 4 about a pair of slide frame pivot pins 26, which are connected to a reinforcing pipe 27. When the feet 11 of the leg frame 8 are removed from their respective leg frame receptacles 9, the slide frame 6 can be lowered about slide frame pivot pins 26 and pipe 27 to a fully collapsed horizontal position against base 4. When the slide frame 6 is in a fully collapsed position, the leg frame 8 and the handle 10 are both pivoted about the pair of handle pivot pins 16 so that they can be folded back to a fully collapsed position alongside collapsed side frame 6. The simulated stair exerciser in fully collapsed position is shown in top view in FIG. 4.

Figure 3:
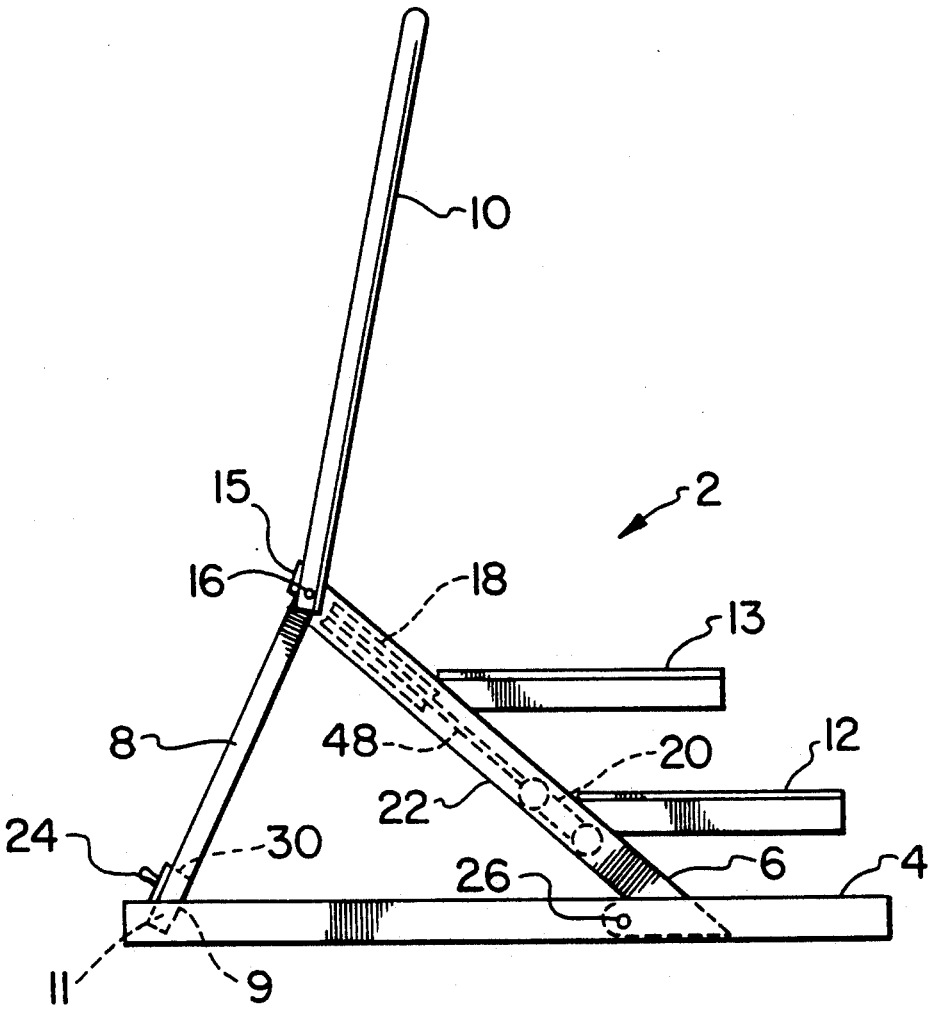
FIG. 3 illustrates a side view of the simulated stair exerciser in erect position.

FIG. 3 illustrates a side view of the simulated stair exerciser 2 in erect configuration. FIG. 3 illustrates the manner in which the pair of foot rests 12 and 13 are slidably mounted on the upper surface of the slanted slide frame 6. The lower foot rest 12 is shown detachably secured to a foot rest dolly 20 which can be readily moved upwardly or downwardly in the interior of the square tubing 22 which forms the left side of the slide frame 6 (as seen in FIG. 3).

FIG. 3 also illustrates the cable wheel 18 (shown in dotted lines) and the cable 48 (also shown in dotted lines) which form part of the foot rest adjustable tension mechanism. The cable wheel 18 is positioned in the upper portion of the slide frame 6, while the cable 48 which extends downwardly from the cable wheel 18 inside square tubing 22 is connected to the foot rest dolly 20. While not visible in FIG. 3, the cable 48 extends over the top of wheel 8 and down the other tubing 22 to connect with the dolly 20 to which the other foot rest 13 is connected.

FIG. 3 also illustrates leg frame lock 24 which is pivotally secured to the forward portion of base 4, and when snapped into locked position (as shown in FIG. 3), fits over leg frame cross bar 30 and holds the two leg frame feet 11 securely in the respective leg frame receptacles 9. Thus, when the exerciser is exercising vigorously on the foot rests 12 and 13, and hangs onto the upright handle 10, which is held in upright position against leg frame 8 by means of stops 15, there is no danger that the two feet 11 can come free from the receptacles 9.

Figure 4:
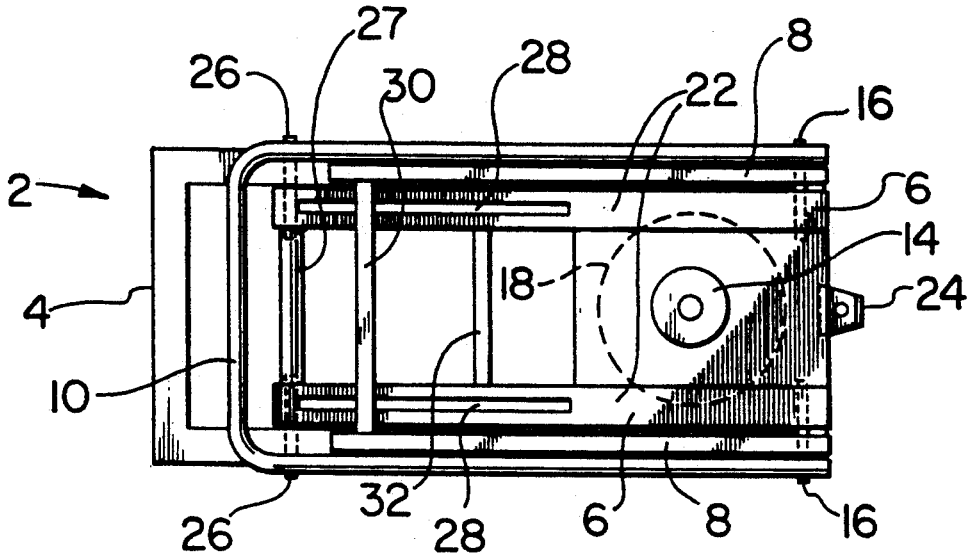
FIG. 4 illustrates a plan view of the simulated stair exerciser in fully collapsed position.

FIG. 4 illustrates a top view of the simulated stair exerciser 2 in fully collapsed configuration. As seen in FIG. 4, the slide frame 6, when collapsed, fits snugly between leg frame 8, which is also in fully collapsed position. The collapsed handle 10 fits outside the leg frame 8. The leg frame 8 and the handle 10 are pivotally connected by a pair of handle pivot pins 16, which are located at the forward (right) end of the stair exerciser 2, as seen in FIG. 4. The slide frame 6 is pivotally connected at the opposite end from pivot pins 16 by a pair of slide frame pivot pins 26, which on their interior ends are connected to an interconnecting pipe 27, which provides stability to the base 4 and slide frame 6. A leg frame cross bar 30 extends across the free end of the leg frame 8. The leg frame cross bar 30 provides dimensional stability to the leg frame 8, and at the same time, provides a solid point against which leg frame lock 24 can be pivotally connected, when the leg frame 8 is in raised position.

FIG. 4 also illustrates the pair of foot rest slide slots 28, which are formed in the top portions of the pair of square tubings 22, constructed on each side of the slide frame 6. A base crossbar 32 extends between the sides of the base 4 and provides a location where foot rests 12 and 13 can be stored when not in use.

Figure 5:
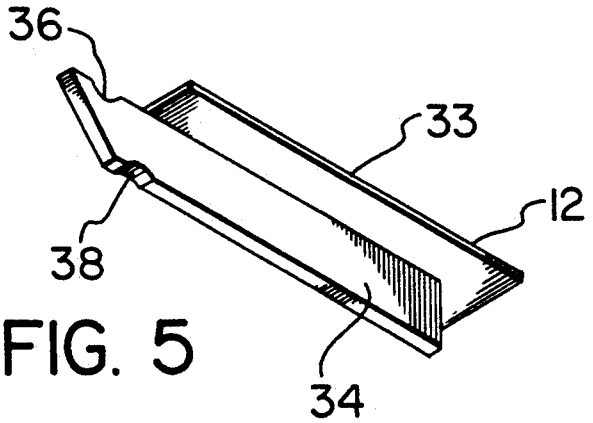
FIG. 5 illustrates an isometric view of a foot rest.

FIG. 5 illustrates an isometric view of the underside of the foot rest 12. Foot rest 13 is constructed in the same way. The foot rest 12 is constructed so that it has a horizontal upper rectangular plate 33, with a vertical foot rest base 34 connected to the mid-region of the underside of plate 33. The foot rest base 34 extends beyond the plate 33 and has formed in the upper side thereof a top notch 36, and on the underside thereof a shallow bottom notch 38. The upper notch 36 and the bottom notch 38 are used to detachably engage the base 34 to a foot rest dolly 20, as will be explained in further detail below.

Figure 6:
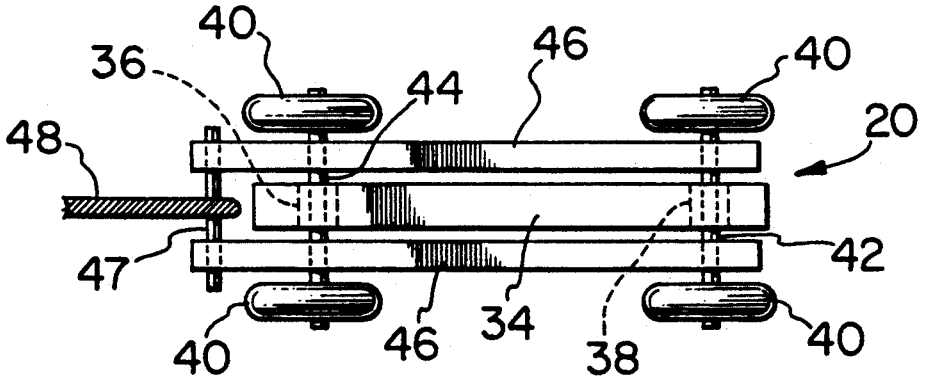
FIG. 6 illustrates a top view of a foot rest dolly.

FIG. 6 illustrates a top view of a foot rest dolly 20. There are two foot rest dollies 20 in each exerciser 2. Each foot rest dolly 20 travels in the interior of the respective left and right square tubing 22 as shown in FIG. 3. The foot rest dolly 20 is constructed so that it has four wheels 40, located at the four corners thereof. These wheels 40 can be constructed of polypropylene or nylon or some other suitable longlasting relatively low friction material. The rear pair of wheels 40 are connected to a dolly frame 46 by rear axle 42. The forward wheels 40 are connected to the dolly frame 46 by front axle 44. The two axles pass through and connect a pair of side frames 46. The two parallel members of the frame 46 have attached at the front end thereof a pin 47 to which is connected cable 48 (which is also illustrated in dotted lines in FIG. 3). As seen in FIG. 6, the forward end of the foot rest base 34 (see FIG. 5) detachably fits between the two parallel members of the dolly frame 46. The top notch 36 (shown in dotted lines in FIG. 6) fits under forward axle 44. The more shallow bottom notch 38 (shown in dotted lines in FIG. 6) fits over the rear axle 42. Thus, the foot rest base 44 can be detached from the dolly 20, by first sliding notch 38 off the rear axle with an upwardly tipping motion and then detaching the top notch 36 from axle 44.

Figure 7:
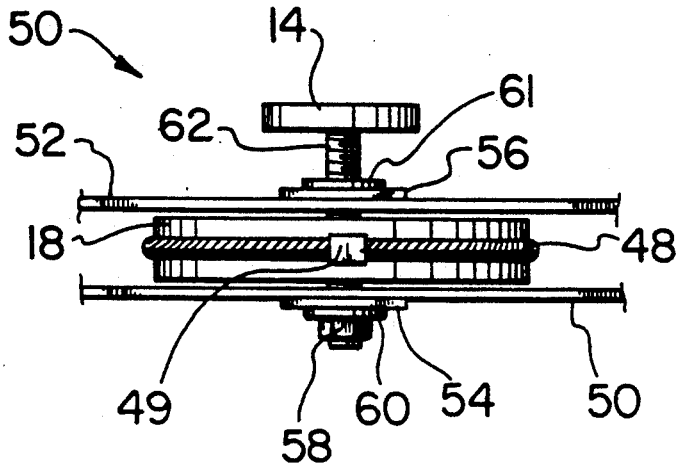
FIG. 7 illustrates an end view of the adjustable foot rest resistance mechanism.

FIG. 7 illustrates a front view of the adjustable tension mechanism 51. This mechanism 51 enables the degree of resistance provided on each foot rest 12 to be varied according to the preference of the person using the simulated stair exerciser 2. The mechanism 51 basically relies upon friction force exerted on each side of wheel 18 by a bottom plate 50, which is connected to the slide frame 6, and a freely moveable top plate 52. If desired, some form of lubricant such as silicone or the like, can be used between the rubbing surfaces of the cable wheel 18 and the respective bottom plate 50 and top plate 52.

The rotatable handle 14 can be turned clockwise or counterclockwise in order to screw or unscrew threaded shaft 62 into the interior of threaded nut 58. In this way, the threaded shaft 62 is tightened or loosened relative to nut 58, and in turn, this increases or decreases the force applied by the top plate 52 and the bottom plate 50 against each side of the cable wheel 18.

In order to apply uniform pressure against the exterior surfaces of the bottom plate 50 and the top plate 52, a bottom pressure bar 54 formed of spring steel, and a top pressure bar 56, also formed of spring steel, bear against the exterior faces of bottom plate 50 and top plate 52 respectively. A washer 60 is positioned between nut 58 and bottom pressure bar 54 to ease rotation of the shaft 62. To enable a force to be applied against top pressure bar 56, a washer 61 secured to threaded shaft 62 rotates with the shaft 62 and either applies more force or less force against the bars 54 and 56, depending upon whether tension adjustment handle 14 is rotated clockwise or counterclockwise.

FIG. 7 also illustrates the manner in which the cable 48 passes around the circumference of cable wheel 18. In order to prevent the cable 48 from slipping relative to cable wheel 18, the central region of the cable 48 is anchored to the wheel 18 by cable anchor 49.

In conducting tests with a prototype, it has been discovered that if desired, the exerciser 2 can be used by having no force exerted on the wheel 18 by plates 50 and 52. In that case, the user continuously presses down with both legs at all times, a slightly greater force being exerted on the downwardly moving leg and foot rest. In this way, the exerciser can exercise both legs at all times. When friction on the friction wheel 18 is exerted by tightening handle 14, the exerciser can "rest" the upwardly moving leg while the downwardly moving leg exerts force against the friction created by the wheel 18.

Figure 8:
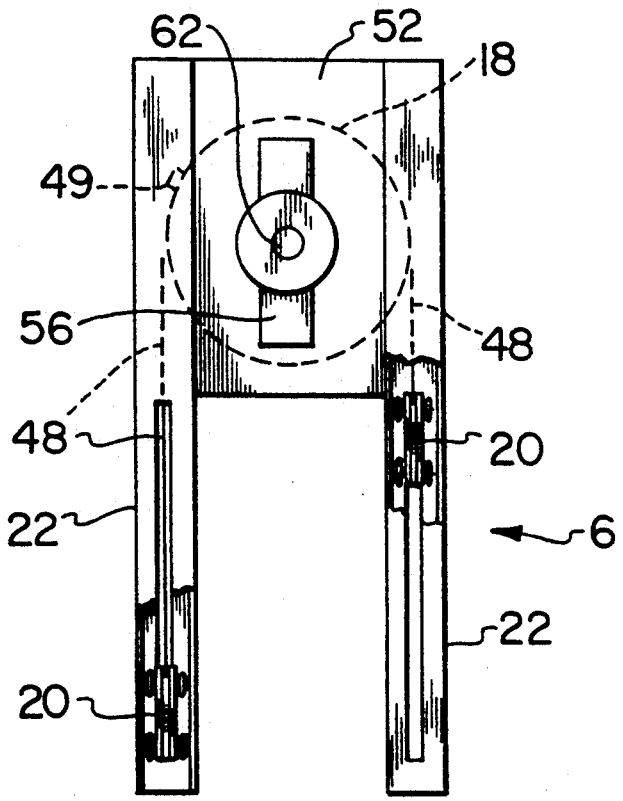
FIG. 8 illustrates a front partial section view of the leg frame and adjustable foot rest resistance mechanism.

FIG. 8 illustrates a front view of the construction of the slide frame 6, and the manner in which the cable wheel 18 is positioned in the interior of the top portion of the slide frame 6, and cooperates with the pair of dollies 20, which travel upwardly or downwardly in the interior of the left and right legs of square tubing 22, located on each side of the top plate 52. The bottom plate 50 (not visible), is welded to the two tubings 22. The top plate 52 is free and can move against or away from wheel 18. The top end of top plate 52 bends at right angles to cover the end of the slide frame 6 and conceal wheel 18 between the two plates 50 and 52. FIG. 8 also shows top pressure bar 56 which is located at the top of the slide frame 6 between the two tubings 22.

As seen in FIG. 8, when the respective foot rests 12 and 13 (not shown) are detachably connected to the left and right dollies 20, and one is depressed relative to the other, the cable wheel 18 rotates accordingly. Thus, when the exerciser, for instance, presses downwardly on the right foot rest, in order to force it down, the dolly 20 detachably connected to that foot rest will roll downwardly inside square tubing 22 located on the right side of slide frame 6. When that dolly 20 reaches the end of its downward travel, the left dolly 20 and the left foot rest (not shown) have been pulled upwardly by clockwise rotation of wheel 18 and cable 48, and moved to an upper position. The exerciser then depresses the left foot rest (not shown) which in turn forces the left dolly 20 downwardly inside left square tubing 22. When the left dolly 20 is forced downwardly, it pulls on cable 48 which in turn causes table wheel 18 to rotate counterclockwise. This in turn causes the right dolly 20 to move upwardly inside right square tubing 22. The process is repeated continuously, in reciprocal fashion, thereby providing a simulated stair climbing exercise routine.

Figure 9:
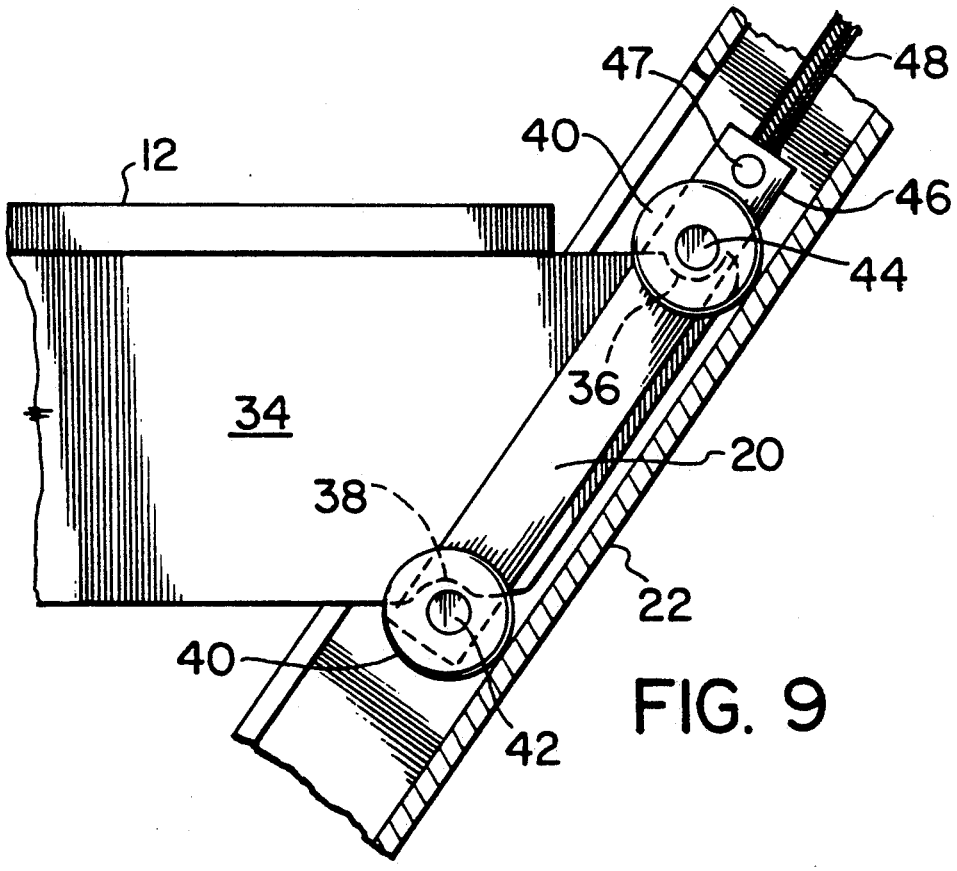
FIG. 9 illustrates a side partial section view of the removable foot rest attached to the foot rest dolly in the slide frame.

FIG. 9 illustrates a side partial section view of the manner in which foot rest 12 detachably connects to dolly 20, which travels upwardly and downwardly within square tubing 22. As shown in FIG. 9, the upper notch 36 formed in foot rest base 34, hooks under front axle 44, while the shallow bottom notch 38 hooks over rear axle 42 of the dolly 20. The bottom notch 38 is shallow so that it can be lifted off rear axle 42 by pulling up on foot rest 12. Gravity helps keep the foot rest 12 in place. This detachable hooking arrangement for foot rest 12 provides firm support while the stair exerciser 2 is being used, and enables the foot rests 12 and 13 to be detached, when the stair exerciser 2 is not being used.

Figure 10:
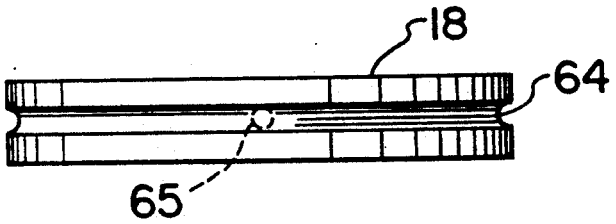
FIG. 10 illustrates an end view of the cable wheel.

FIG. 10 illustrates an end view of the cable wheel 18, which forms part of the tension adjustment mechanism of the stair exerciser 2. A cable wheel groove 64 is formed around the circumference of the wheel 18, in order to keep the cable in place free from binding. The cable anchor 49 (not shown) is screwed into hole 65.

Figure 11:
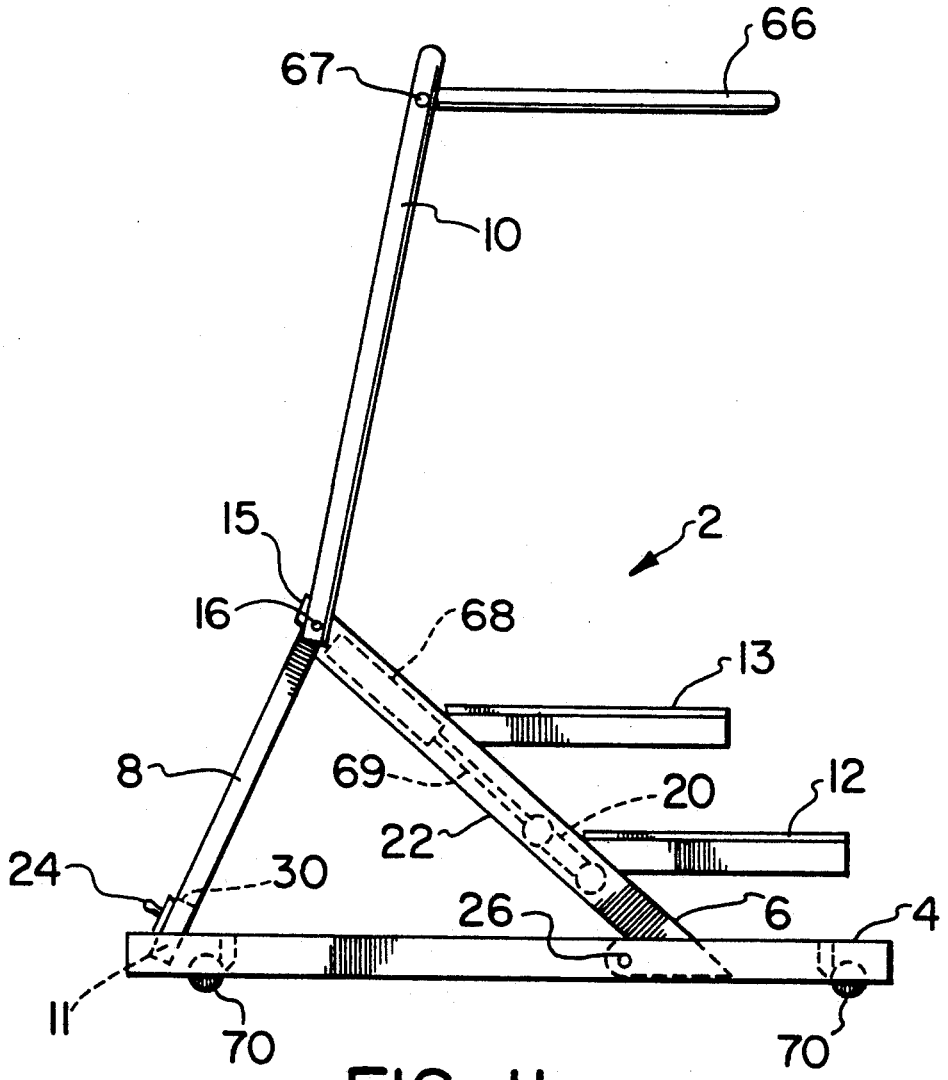
FIG. 11 illustrates a side view of an alternative embodiment of the exerciser equipped with hydraulic cylinders for foot rest resistance, folding arm rests and retractable wheels.

FIG. 11 illustrates a side view of an alternative embodiment of the exerciser with hydraulic cylinders for foot rest resistance, folding arm rests and retractable wheels. The handle 20 has on each side thereof arm rests 66 which can be pivoted downwardly or upwardly about pins 67 or wing nuts (depending on how long handle 10 is) when the exerciser 2 is collapsed for storage. Instead of the dolly 20, cable 48 and wheel 18 reciprocating mechanism, the resistance force for the foot rests 12 and 13 is provided by adjustable hydraulic or pneumatic cylinders 68 and rods 69. If deemed suitable, springs, such as coil springs, can be used in place of cylinders 68, or dollies 20.

While not shown in FIG. 11, a wheel 18 and cable 48 can be used to ensure that the two foot rests 12 and 13 move upwardly and downwardly in reciprocal fashion. Alternatively, the two cylinders 68 can be hydraulically connected so that when the oil in one cylinder is exhausted, it passes to the other cylinder in order to move that cylinder. Valves can be used to ensure proper oil flow. If desired, springs can be used in cooperation with hydraulic cylinders in order to achieve a reciprocating pedal action.

FIG. 11 also illustrates retractable wheels 70 which can be mounted on the underside of base 4. These wheels 70 can be conventional spring loaded caster wheels which retract against respective springs when a load is placed on the exerciser 2. In that way, the exerciser rests firmly on the ground or floor when in use, but when not in use can be rolled to a storage position.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A simulated stair exerciser apparatus comprising:

(a) a base;

(b) a slide frame having first and second ends, the first end of which is pivotally attached to the base, the slide frame comprising first and second parallel slide members, the slide members being adapted to have respective foot rests slide upwardly or downwardly on the upper surface of each slide member by means of moveable first and second dollies on respective interiors of the first and second slide members;

(c) a leg frame having first and second ends, a first end of which is pivotally attached to the slide frame at a second end of the slide frame, the second end of the leg frame removed from the first pivotal end being detachably connected to the base;

(d) a handle pivotally joined to the second end of the slide frame;

(e) a pair of detachable foot rests adapted to cooperate with the first and second dollies through openings in the respective first and second slide members and to move upwardly or downwardly along the slide frame in conjunction with the respective first and second dollies; and, (f) an adjustable resistance means which exerts a resistance force on the pair of foot rests and enables the slide resistance of the respective foot rests to be varied.

2. An exerciser as claimed in claim 1 wherein the slide frame has in the interior thereof a wheel, with a cable with ends extending around the periphery of the wheel, the ends of the cable removed from the wheel being respectively connected to the respective first and second dollies in the respective first and second slide members.

3. An exerciser as claimed in claim 2 includes a force means which exerts a force against the wheel, thereby enabling the degree of rotational resistance of the wheel to be adjusted.

4. An exerciser as claimed in claim 3 wherein the leg frame can be locked into position when connected to the base.

5. An exerciser as claimed in claim 3 wherein the slide frame, leg frame and handle can be pivotally collapsed so that they are adjacent to the base to provide a compact configuration.

6. An exerciser as claimed in claim 3 wherein the pair of foot rests travel in respective elongated slots formed in the first and second slide members of the slide frame, and the first and second dollies travel inside the first and second slide members parallel to the slots.

7. An exerciser as claimed in claim 1 wherein the resistance means comprises at least one hydraulic or pneumatic cylinder which exerts adjustable resistance force to movement of the pair of foot rests.

8. An exerciser as claimed in claim 7 wherein a cable connects the pair of foot rests to provide reciprocal action.

9. An exerciser as claimed in claim 1 wherein the resistance means is a spring.

10. An exerciser as claimed in claim 1 wherein the handle is pivotally connected to the leg frame.

* * * * *